United States Patent [19]

Simnovec et al.

[11] Patent Number: 4,799,573

[45] Date of Patent: Jan. 24, 1989

[54] ADJUSTABLE PERSONNEL PLATFORM

[75] Inventors: Andrej Simnovec, Recklinghausen; Bernhard Meinken, Haltern; Friedrich Schwing, Herne, all of Fed. Rep. of Germany

[73] Assignee: Friedrich Wilh Schwing GmbH, Fed. Rep. of Germany

[21] Appl. No.: 105,961

[22] Filed: Oct. 2, 1987

Related U.S. Application Data

[63] Continuation of Ser. No. 565,114, Dec. 23, 1983, abandoned.

[51] Int. Cl.[4] ..... B66F 11/04

[52] U.S. Cl. ..... 182/2; 187/9 R

[58] Field of Search ..... 187/9 E, 9 R, 25; 182/2; 74/409, 440

[56] References Cited

U.S. PATENT DOCUMENTS

| | | | |
|---|---|---|---|
| 1,967,376 | 7/1934 | Smith et al. | 182/2 |
| 2,483,811 | 10/1949 | Cullen | 182/2 |
| 2,938,594 | 5/1960 | Eitel | 182/2 |
| 3,526,295 | 9/1970 | Cornet | 182/2 |
| 3,590,948 | 7/1971 | Milner | 182/2 |
| 3,590,948 | 7/1971 | Milner, Jr. | 182/2 |
| 3,860,088 | 1/1975 | Gellatly | 182/2 |
| 4,051,923 | 10/1977 | Blanchette et al. | 187/25 |
| 4,116,304 | 9/1978 | Durnell | 182/2 |
| 4,411,511 | 10/1983 | Ariyama et al. | 355/3 |

FOREIGN PATENT DOCUMENTS

| | | | |
|---|---|---|---|
| 2819256 | 11/1979 | Fed. Rep. of Germany . | |
| 2901786 | 7/1980 | Fed. Rep. of Germany | 182/2 |
| 52541 | 4/1945 | France . | |
| 1101852 | 10/1955 | France . | |
| 1553126 | 1/1969 | France . | |
| 2106543 | 5/1972 | France . | |
| 2347304 | 11/1977 | France . | |

*Primary Examiner*—Joseph J. Rolla
*Assistant Examiner*—Nils E. Pedersen
*Attorney, Agent, or Firm*—Andrus, Sceales, Starke & Sawall

[57] ABSTRACT

An adjustable personnel platform (38) is rotatably fastened on a lift tower end, with a carrying arm (42) and a pivot link (43) in the pivot plane of the elements (15, 21, 26) of the lift tower. It is automatically held horizontal through a reversable electric motor (96) and a speed translating drive (66, 67) as well as through a control surrounding a regulator with an inclination measuring device (92). The speed translating gear drive (66, 67) directly drives the rotatable part (64) of the pivot link (43). Between carrying arm (42) and the motor a plurality of direction changing couplings (81, 86) are provided. They arrest the rotation of the carrying arm (42) in both directions of rotation and release the rotary direction of the carrying arm (42) in a respective one of the rotary directions of the motor (97).

7 Claims, 8 Drawing Sheets

Figures 1, 2, 3:
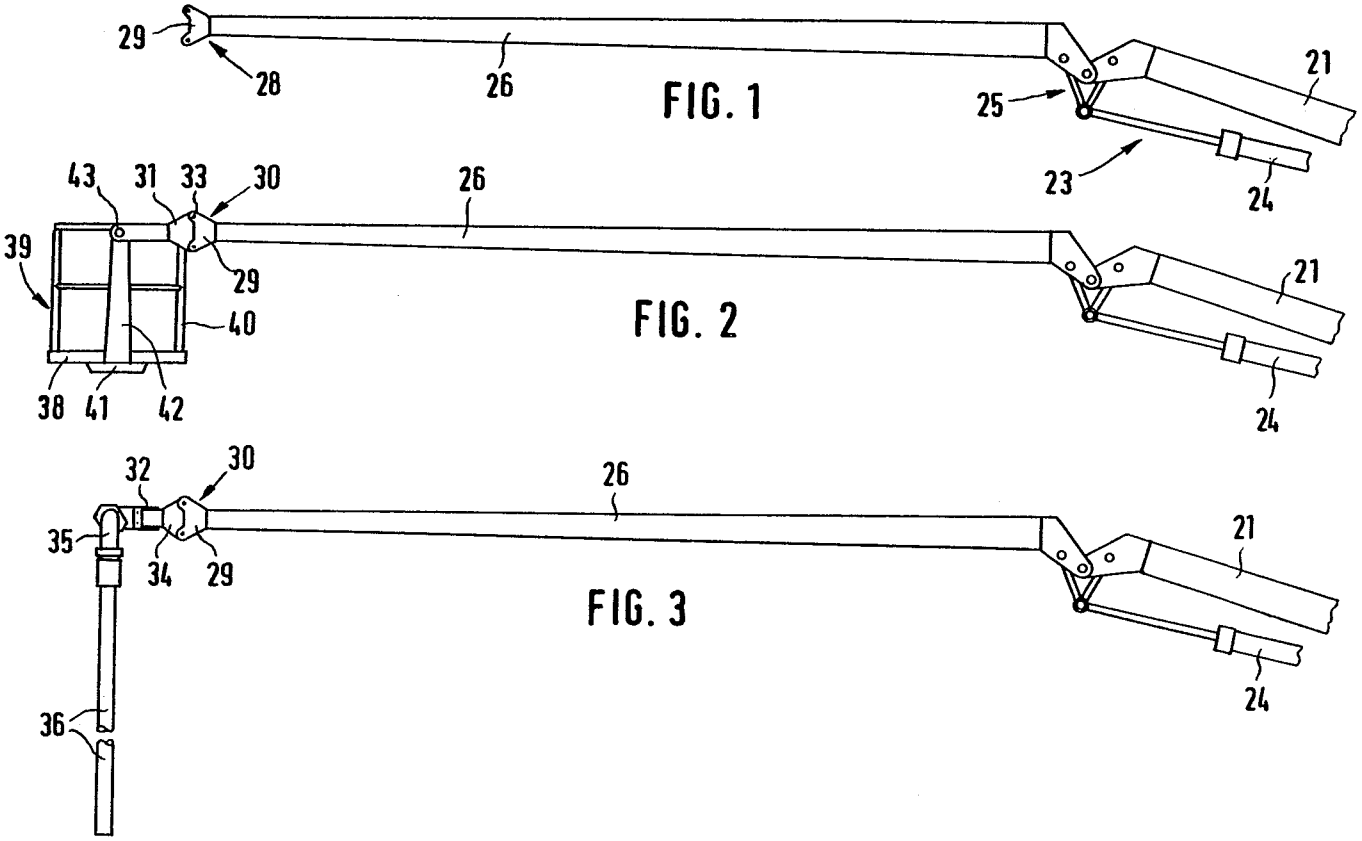

21
24
23
25
26
28
29

21
24
26
30
29
40
33
31
42
43
41
38
39

21
24
26
30
29
34
32
35
36

ADJUSTABLE PERSONNEL PLATFORM

The present application is a continuation application of U.S. patent application Ser. No. 565,114, filed Dec. 23, 1983 and now abandoned.

The invention relates to an adjustable personnel platform.

Such personnel platforms make possible the raising and lateral movement of workers, if necessary with the work implements found with them on the platform, to the faces of buildings or high objects, such as masts, airplanes, ships, or the like. They can however, also be used to retrieve people from dangerous circumstances in otherwise inaccessible places. The lift tower is assembled mainly out of a plurality of sections or elements, the lower element part of which is usually designated as the base boom and the end part of which ordinarily as the flying boom. The parts of the lift tower are connected with each other through swivel joints having mainly hydraulically operable thrust piston drives and are foldable in a plane. The base boom is linked rotatably movable on a kingpin of a rotating mechanism generally in this swivel plane. With the rotating mechanism, one determines the possible lateral displacement of the platform with respect to a fixed point. This can be either fixedly arranged or can be mobile. In the last named circumstance the lift tower forms the element of a vehicle, for example, a trailer truck.

The invention arises out of a previously known apparatus of this type (DE-OS No. 28 19 256). In this embodiment the adjustable platform is constructed as an interchange or auxiliary apparatus for a truck load crane. This is, for its part, remotely controllable. In this case, the regulator, the regulating quantity of which is the possible slope of the personnel platform with respect to the horizontal, takes care of this so that this, independently of the movement of the lift tower end, is held to predetermined narrow limits of approximately 5° on both sides on the basis of safety.

An embodiment of this previously known personnel platform provides an electrical drive motor as the drive of the swivel joint. That has the considerable advantage of use of different media, namely of the hydraulic medium for the displacement of the lift tower and use of the electrical medium for the drive of the personnel platform, so that with loss of the hydraulic lift tower drives, that are then blocked, the work platform can be brought to its horizontal position.

In this embodiment the drive has a worm input stage, the worm gear of which, arranged fastened to the housing, has an inner gearing for a spindle. This drive is non-rotatably and flexibly linked adjacent the swivel joint of the carrying arm on the lift tower and on the carrying arm of the platform. In this manner the relatively high rotational speed of the electric drive motor is reduced to the slow rotation of the carrying arm in the swivel joint.

On the other hand there arises out of this, particularly with respect to the limited, effective length of the spindle, a practical restricted rotation of the carrying arm to a quadrant in both rotary directions of the electrical drive motor. That correspondingly strongly restricts the possible movements of the lift tower end and thus the positions attainable with the personnel platform. The described type of drive also makes possible insufficient speed reduction for fast running direct current motors. That, and the fact that the swivel joint and its rotary drive form separate construction groups leads to a proportionately complicated arrangement that causes a considerable deadload of the lift tower end, so that, inter alia, stability problems can develop.

The known speed reduction drive is, to be sure, automatic locking. Slewing of the personnel platform can, however, terminate the self-locking of the drive and transfer the platform with the disconnection of the electrical current in a position of increased incline that cannot be corrected. In order to eliminate the risks associated with this in an assured manner, a brake must be mounted on the swivel joint. In dangerous circumstances, the prompt operation of this brake occurs with considerable difficulty, that can lead to otherwise avoidable accidents. It has also the disadvantage that with hydraulic apparatus of the lift tower remaining intact, no correction of the platform position can be dealt with upon the loss of the electrical current.

There is a further adjustable personnel platform known that is continuously jointly operated, not with an already existing crane mast as the lift tower, but with an extended lift tower particular to the requirements of the work platform, in particular for its desired radius of action and, accordingly, is permanently fastened to the lift tower end (DE-OS No. 29 01 786). Also in this connection the horizontal position of the personnel platform is preserved in a compulsory manner through a control. The lift tower is however in all cases longer than a mobile crane mast embodiment and has therefore a correspondingly enlarged working region. That affords increased pivot angle of the swivel joint of the mast part elements, that are so laid out that the mast increased in its length can be brought in a folded together position, in which its partial elements lie parallel and in which it can be easily transported.

Such a lift tower demands in the swivel joint of the carrying arm, as compared to the known electrically driven swivel joint, a considerably increased swivel angle. Thus this known embodiment needs a hydraulic thrust piston drive as the drive, the swivel angle of which one can increase through mechanical guide rod drives up to 240° and subdivide moreover the arm with a further swivel joint of this type. However the division of two drive media on the carrying arm swivel joint and the lifting tower swivel joints is then no longer practical. Against that arise considerations of safety because the swivel joint and the positioning of the lifting tower must occur with the hydraulic medium, so that with the loss of the hydraulic apparatus the position of the personnel platform can no longer be corrected.

As a result of the hydraulic execution the control circuit surrounding the regulating device is extraordinarily complicated and unsatisfactory because it must work with hydraulic and electrical energy. Thus there results particularly the problem of oscillations of the regulating circuit about the desired value that leads to considerable swinging in the personnel platform.

Further, the dead load of the lift tower is proportionately large because the piston drive filled with working fluid and serving as the drive of the carrying arm as well as its possibly inserted link transmission are very heavy.

The invention has as its object to so form the adjustable personnel platform previously set out that it not only serves as interchangeable apparatus but also can selectively be used as continuously mounted working apparatus with a versatile adjustable lift tower and offers greater safety for the persons located on the platform.

According to the invention this object is achieved through the characteristic features of the invention defined in the claims.

According to the invention the limit of the rotary angle of the carrying arm of the personnel platform is fully cut off in both rotary directions of the motor through the gear drive so that the personnel platform can be employed together with any adjustable lift tower construction form. The gear drive is, in construction form not sufficiently self-locking to disconnect the pendulum of the platform in the carrying arm swivel joint. It is however for the invention made usable through the direction controlling coupling. With this coupling, the controlling action depends on the direction of the relative rotation between the input and output drive elements. While one so employs a plurality, that is, in particular, two of these, for example as elastic roller free running formed, couplings, that their free running condition gives, in each case, one direction of the motor rotation and their locking condition governs in both rotary directions of the carrying arm, one can automatically switch out the pendulum of the platform. That makes possible, with the disconnection of the electrical energy, the avoidance of unintentional slanting positions of the personnel platform and in the normal instance the avoidance of the oscillations about the desired value appearing with most regulators with inclination measurement, which is difficult to govern with respect to the control technique and represents a source of danger for the personnel located on the platform.

The invention has thus the advantage that it in a particular simple manner avoids the heretofore complicated construction form and the therewith connected high expenses and dead load. It permits nonetheless a practically unlimited working region of the personnel platform and can in particular as an interchangeable apparatus make possible the multiple utilization of complicated lift towers.

Preferably and according to a further feature of the invention the use of a fast running motor, for example, a pneumatic or hydraulic drive motor is possible because it points out that with proportionately small capacities, the torque necessary on the carrying arm can be applied from such motors. The according to the invention this suggested distribution of the drive has the advantage that with the worm section a speed translation is achievable that amounts for example to 1:8 and it makes possible in the case of danger to position the platform horizontally with small rotations of the hand wheel. On the other hand, the planetary gear drive output stage has the advantage that it, with overloading of the platform, the necessary braking load are easy to achieve because of the continuous engagement of a plurality of gears and thus makes possible altogether a light construction form it is further possible with an exemplary embodiment of the invention to realize an electrical drive form of the carrying arm swivel link of the personnel platform that utilizes fast running direct current motors. With such fast running there is concerned direct current motors, the rotor of which is formed out of an iron-free hard plastic disc with the current conductors mounted thereon, whereby the nominal speeds are achieved between 2100 rpm to 4500 rpm and the maximum rotary speed up to 6000 rpm. The series planetary drive makes possible in the joint operation with the worm gear input stage a sufficient reduction of these high speeds. The armatures have a ring shaped winding cage that is surrounded inside and outside by the field.

One can, in these exemplary embodiments of the invention, construct then with drives of small form and with very small electrical conductors, that on their part make possible a further weight reduction and thus simplify the problem of stability.

With such exemplary embodiments of the invention it is also possible to store the necessary electrical power for the driving of the swivel joints for one or more installation (claim 4). One is thus independent from the electrical battery of the vehicle and achieves therefore an additional security because, in itself, with the removal of the electrical current, sufficient energy for the preservation of the horizontal position of the personnel platform is available.

A particularly advantageous embodiment of the invention is possible with a lift tower that has a very large operating range. Such a lift tower makes it possible, in particular, building parts to overlap or to underlap.

Figure 4:
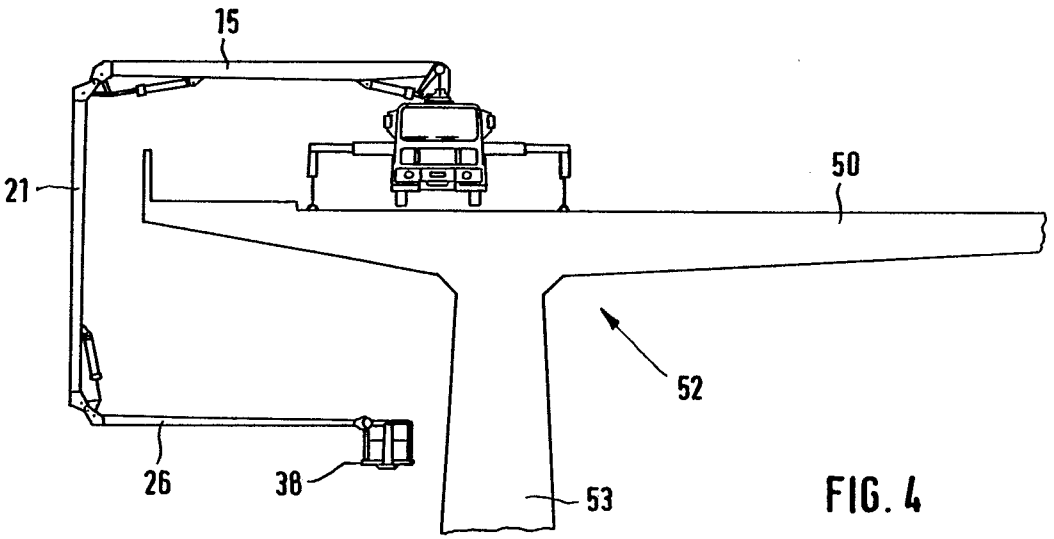
Figure 5:
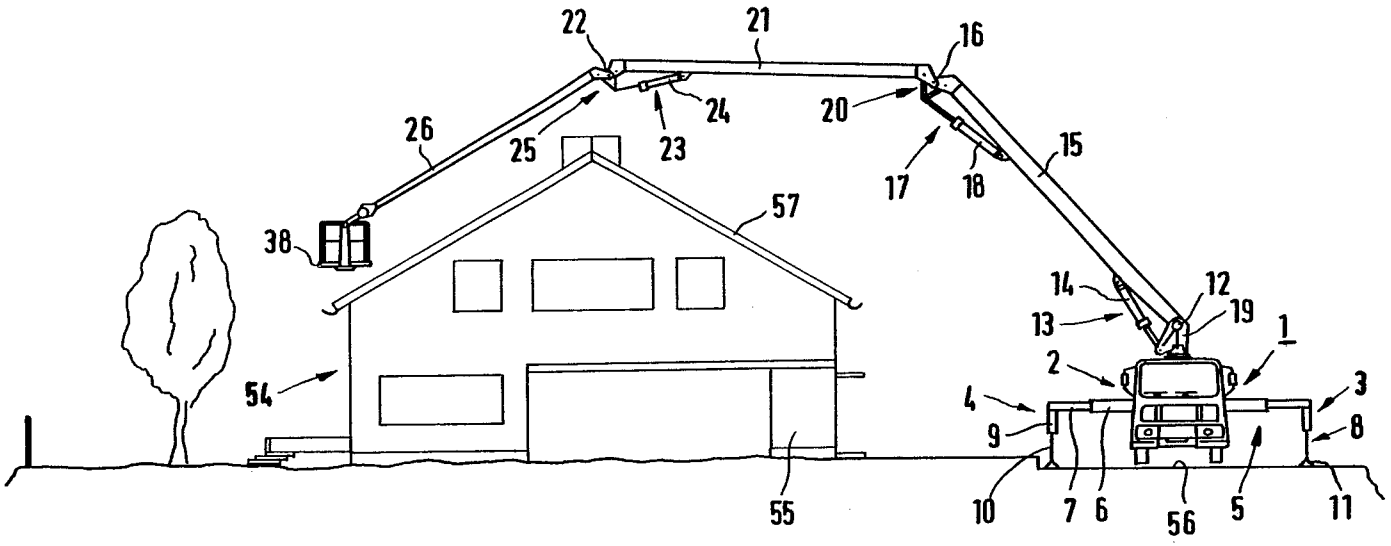
Figure 6:
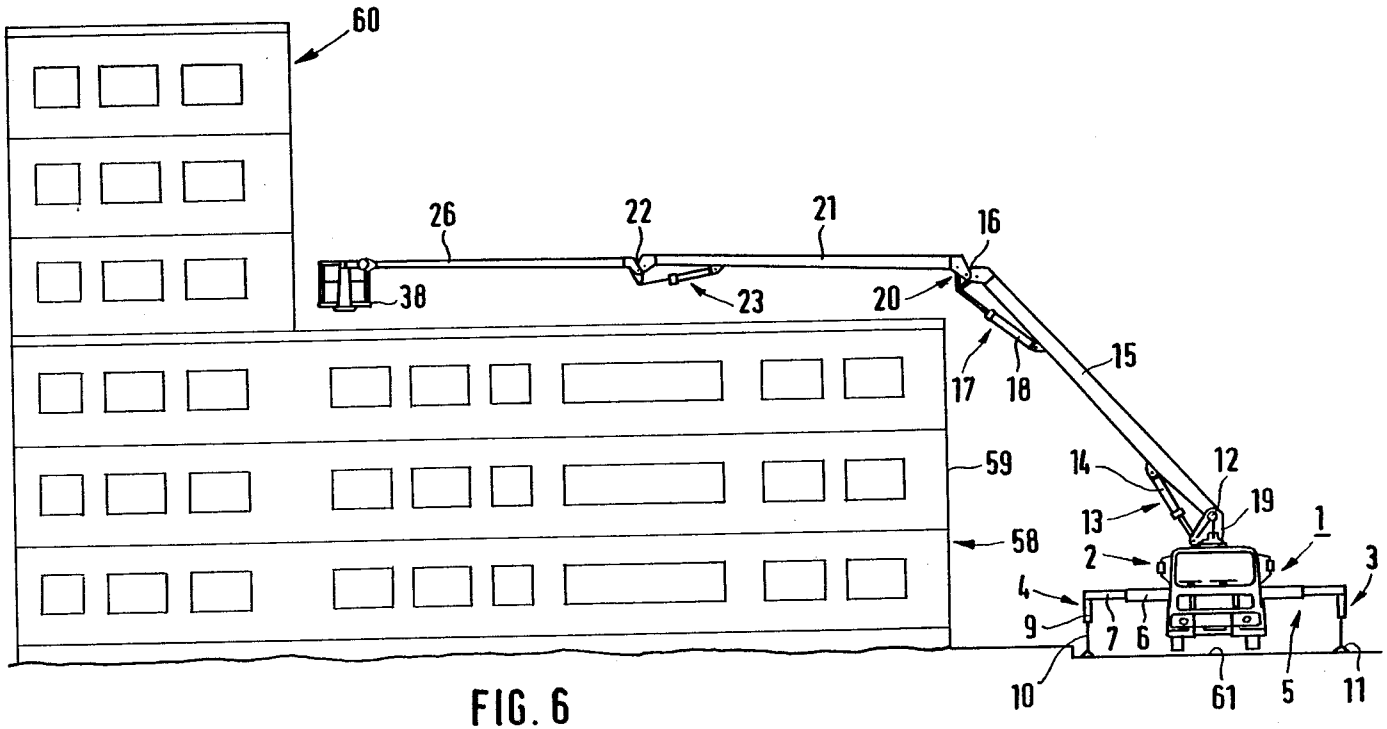
Figure 7:
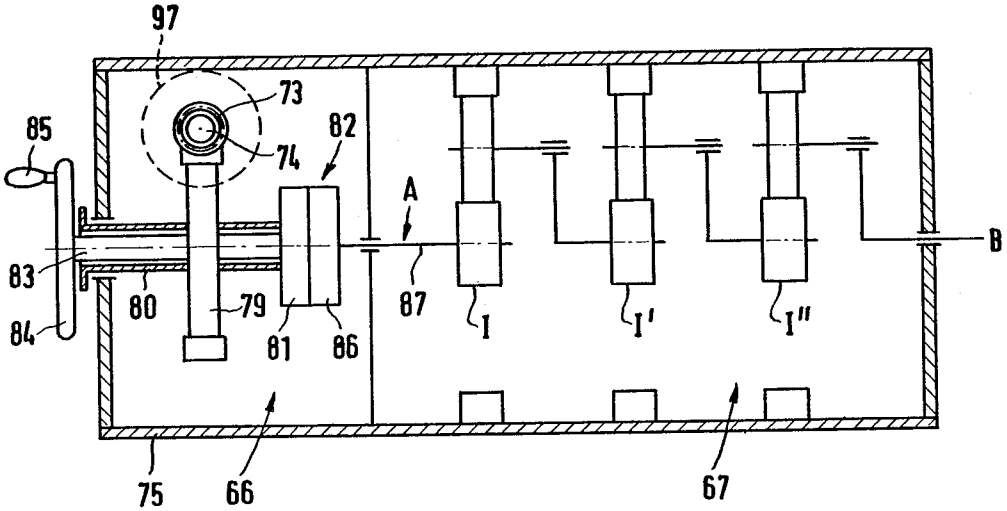
Figure 8:
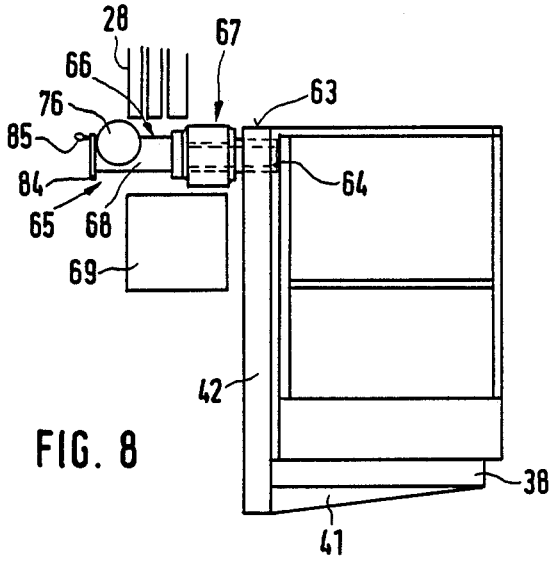
Figure 9:
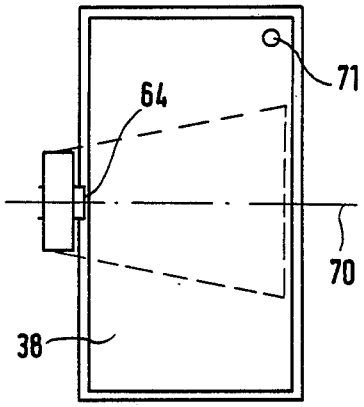
Figure 10:
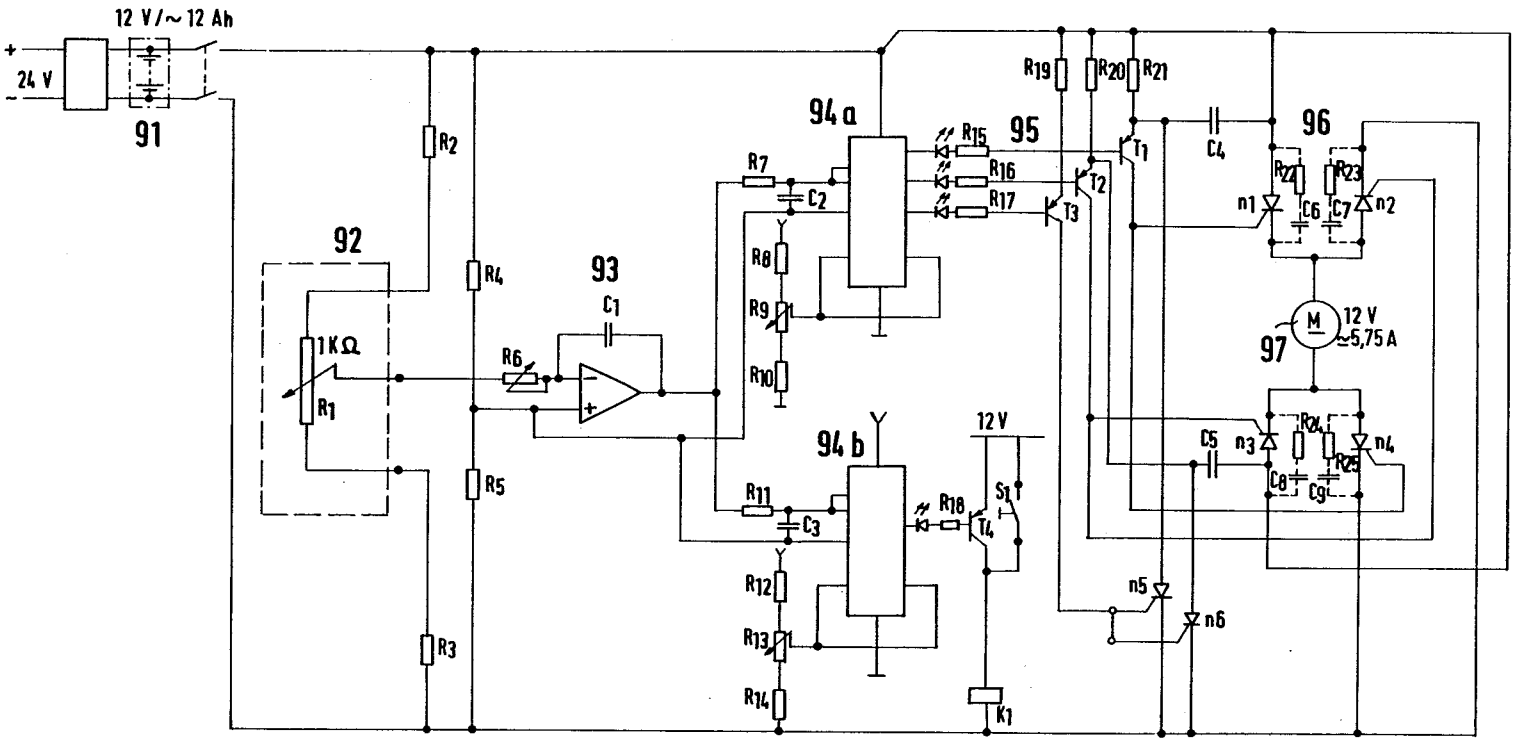
Figure 11:
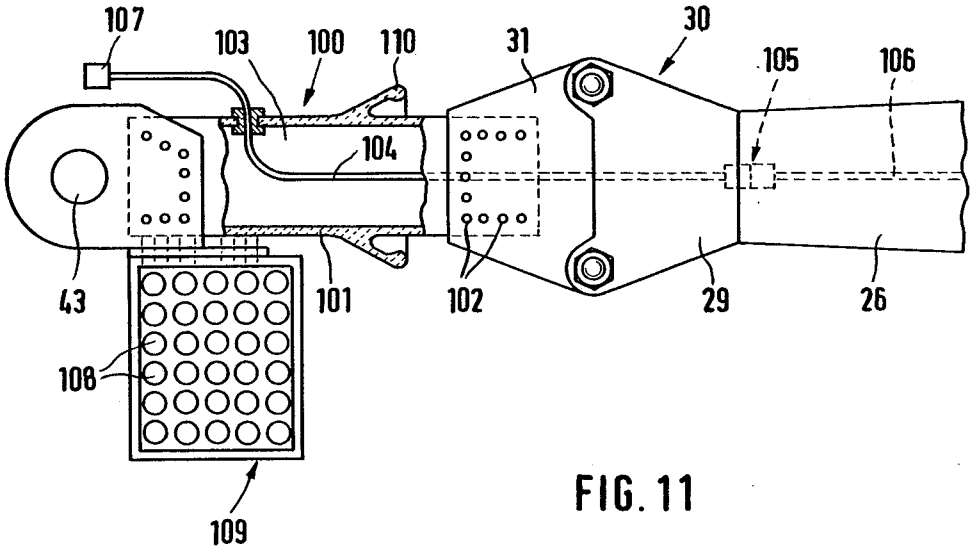

The details, further features, and other advantages of the invention will be apparent from the following description of an exemplary embodiment with the aid of the figures in the drawing; which show:

FIG. 1 the flying boom and the connected intermediate member of a lift tower, that can be used together with the adjustable personnel platform according to the invention so that the latter is formed as an attachment, FIG. 2 the finished, equipped lift tower for the adjustable personnel platform, FIG. 3 the lift tower according to FIGS. 1 and 2 in use as a concrete distribution tower, FIG. 4 a possible work position of the lifting tower for the inspection of a bridge deck, FIG. 5 the lift tower with the employment of the adjustable personnel platform as a rescue apparatus;

FIG. 6 another illustration of the lift tower as a rescue apparatus corresponding, in illustration, to FIG. 5, FIG. 7 a schematic illustration of the swivel joint drive, FIG. 8 a schematic illustration of the swivel link and the personnel platform in the exemplary form according to FIG. 1–6 in front view, FIG. 9 a plan view of the subject matter of FIG. 8, FIG. 10 a circuit diagram and, FIG. 11 an embodiment of the invention particularly suited for working with electrical power elements.

According to the illustration of FIGS. 5 and 6, an assembly indicated generally with 2 is provided on a truck frame 1, that is connected with the longitudinal members of the truck chassis. The assembly has a plurality of lateral supports 3, 4, that for their part are formed as telescopable, preferably hydraulically driven outriggers 5 with a drive formed as a hydraulic thrust piston drive from a cylinder 6 and a piston rod 7. At their ends they have support struts 8, that for their part are formed of a hydraulically actuatable cylinder 9 and an extendable piston rod 10 with base plate 11.

Beyond the cab is located a turntable, not shown, that however has a vertical pillar 19, that can move about the kingpin of the turntable. It serves for the support of a swivel joint 12 with a drive 13 formed of a thrust piston swing drive 14. The swivel joint 12 connects a base boom 15 to the pillar 19. The end of the base boom carries a further swivel joint 16, that has a swing drive 17. The swing drive 17 also possesses, as a motor, a thrust piston drive 18 with a force transmitting lever 20. The swivel joint 16 serves for the connection of an intermediate member 21 to the base boom 15. The free end of the intermediate member 21 carries a swivel joint 22 that for its part is provided with a drive 23, that is formed of a thrust piston 24 and a guide drive 25 and also for its part just as the drive 17, is effective through a pivot angle of 180°.

The swivel joint 22 serves for the connection of a flying boom 26, that by means of the swing drive 23 with corresponding actuation of both further swing drives 13 and 17 can be swung into position under the intermediate member 21 and over the base boom 15; that is "roll folded".

The thus far described device is known in principle. It has served, however, up till now only as a concrete distribution tower, that is, pipes are fastened on the mast element parts 15, 21, and 26, that are interconnected through pipe links or hoses, and through which concrete from a concrete pump mounted on the vehicle 1 and connected to assembly 2 is pumped.

According to the invention this device is so modified that the end 28 of the flying boom 26 is formed as half 29 of a coupling 30, of which both halves 29, 31 present a bolted joint 33, that can be loosened at any time. With the coupling half 29 of coupling 30, an assembly element 32 can be bolted on as shown in FIG. 3, the coupling half 34 of which is fastened on the end of the assembly element 32. The other end of assembly element serves for the support of a pipe 35 on which is connected a hose 36. The hose 36 forms the end of the concrete conduit originating from the described concrete pump that is lead through the distribution mast, so that with the hose 36, the distribution of the concrete on the building surface to be cemented is possible.

With a changing of the coupling half 34 as against the coupling half 31 can, on the other hand, an adjustable platform 38 be mounted on the flying boom 26, that in principle is formed of a basket 39 possessing a cage 40. Beneath the platform 38 a rigid carrying arm 42 is fastened with element 41 that projects upwardly at a right angle to the plane of the platform 38 and possesses a pivot link 43 with which the platform 38 is connected with the coupling element 31 and thus with the flying boom 26. The pivot link 43 makes possible a pivoting of the arm 42 in the plane of the previously described swivel joint 12, 16, and 22 of the lift tower.

One of the possibilities that the overall arrangement formed out of the adjustable personnel platform 38 and the described lift tower makes possible is illustrated in FIG. 4. There is here concerned the bridge deck 50 of a highway 52, that is supported as illustrated in exemplary fashion with member 53. By means of the different swing drives 13, 17, and 23 it is possible to move the lift tower out of its, as previously described, closed together—roll folded—position in such a manner, that its base boom, its boom intermediate part 21, and its flying boom 26 form an open U in the direction of the column 53 of the bridge deck 50 so that during the entire pivotal movement the platform 38 is held horizontal in a manner to be described. The same holds true for the return folding of the lift tower in the rolled together position.

While in FIG. 4 a work position of the platform 38 is illustrated that makes possible inspection work, FIGS. 5 and 6 show the use of the work platform 38 as a rescue apparatus. Thus it is undertaken that in the case of FIG. 5 the back side 54 of the illustrated building 55 is not reachable from the street 56 on which the truck 1 is parked. As is apparent from FIG. 5, one can, in this instance, reach this rear side 54 over the roof 57 of the building 55.

In the instance of FIG. 6, a high rise building 58 is selected as the exemplary embodiment, that is constructed with a multi-story building 60 on a flat building 59. One can reach the high rise portion 60 with the work platform 38 with the lift tower formed out of the elements 15, 21 and 26 above the flat building portion that is wide in the direction of the street.

As one can appreciate, particularly from the illustration of FIG. 8, the adjustable platform 38 is with the free end 63 of the arm 42 connected on the drive shaft 64 of a drive illustrated generally with 65; that is, nonrotatably connected with the shaft. The drive has an input stage 66 with one or more worm gear drive stages. On this is connected a planetary gear drive 67, the details of which are particularly apparent from the illustration of FIG. 7. The drive housing is indicated generally with 68 and is flanged on the end of the flying boom. The housing of a control is reproduced by 69 that will be further described below with the aid of FIG. 10 and which provides, in essence, a regulating device including an electrical inclinometer that maintains the platform 38 horizontal. On the work platform 38 can also be provided loads, as at 71 eccentric to the geometric axis 70 of the gearing unit output shaft 64, that for example, are formed of the work implements or persons.

The details of the drive are reproduced in FIG. 7. Accordingly, a worm 73 sits on the input shaft 74 of the gear element 66, on the housing 75 of which the motor housing represented by 76 in FIG. 8 is flanged on. The worm drives a worm gear 79, that is fastened on a shaft 80, that presents a first direction controlling coupling that is subsequently connected to a further coupling 82 connected in the oppositely going direction. Thus there results an effective back lash stop in both rotary directions of the supporting arm. The shaft 80 is hollow and in this manner makes it possible to connect a shaft 83 to the coupling 81 working for example with elastic bodies. The free end of the shaft 83 carries a handwheel 84 with a crank handle 85. The crank handle 85 is reachable from the platform 38 and makes it possible to drive the gear unit 67 from the outside through the hollow shaft 80 with the shaft 83 instead of with the gear unit 66, that is, from the worm 73 and the worm gear 79.

At the output of the back lash stop 81, 82 is located the input shaft 87 of a series planet drive 67 assembled out of three stages. The included subordinate stages run from A to the drive shaft 64 of the drive B. They are indicated with I, I', and I''. With the selected exemplary embodiment the intermediary stages are as follows $I''=i=10.2:1$ $I'=i=10.8:1$ $I=i=6.75:1.$ With a diameter of the handwheel of 125 mm the drive can be rotated with the crank handle 85.

As shown in FIG. 10, the voltage supply of the high speed electric motor 97 is formed of a 12 volt battery 91 that can have a capacity of 20 amp hours. It is supplied from the battery of the vehicle that can have a voltage of 24 volts. The charging of the battery 91 is monitored by an electrical load control. This continuously compares the voltage of the supply battery with the voltage of the vehicle battery. Thus an overloading of the supply battery 91 is precluded.

The electrical inclinometer 92 is provided as a sensor in a two chamber housing and is formed of a pendulum that is dampened with glycerin. The pendulum is connected with a servo-potentiometer out from which the electrical signal is received.

Each voltage change is supplied through an integrator 93 to the electronic threshold circuit 94*a*, 4*b*, and compared with adjustable reference values. These can amount with the shown circuit to ±2°, 0°±8°.

It is so arranged that with a slope of the working platform 38 of, for example, ±2° the thyristors for the output control 96 of the electrical drive motor 97 are fired through the output stage 95. The motor can be constructed as a disc or ring motor.

With the running of this motor the platform is moved into the null position. As soon as an indication of 0° is provided from the sensor, the motor is deenergized.

If a slope greater than ±2° is established, the second threshold circuit 94*b* detects this that provides a signal at 8° slope to a power disconnect that switches out the apparatus. Then the platform can be moved by means of the hand crank 85.

According to the illustration of FIG. 11 a detachable element 100 is threaded on the flying boom 26 of the lift tower through the connection 30. The detachable element 100 is formed of a carrier 101 that comprises a box formed hollow carrier of glass fiber reinforced plastic. This hollow carrier is permanently fastened on the coupling half 31 formed out of steel by means of a plurality of fasteners 102. Through the hollow space 103 of the carrier 101, an end section 104 of an optical glass fiber cable is lead that can be connected, by means of a coupling 105, to the supply cable 106 lead through the lift tower, and with a further coupling 107 to a not disclosed control. The power supply results in this case through a panel 109 provided with solar cells 108. In this manner and through the moisture discharge serving insulators 110, that form a part of the carrier 101 a complete electrical insulation of the personnel platform 38 mounted on the rotary link 43 from the supporting arm 42 with respect to the lift tower is possible. Thus this construction form serves for work on high voltage lines without danger to the persons standing on the personnel platform 38. The control results through the optical glass fiber cable or alternatively through a radio link.

In the illustrated exemplary embodiment, the output shaft 64 of the drive unit 65 forms the rotatable portion of the link 43, while the drive housing 68 represents the stationary portion of the link 43. This drive housing has a flange that is threadable with an opposing flange to the mast arm, i.e. the attachment element 32. Since the motor housing, as illustrated by 76 in FIG. 8, for its part can be flanged to the drive housing 68, there results a reversed apparatus, that however, also can be fixedly mounted to a lift tower. The output shaft 64 forming the rotary part of the link 43 can be connected to the lift arm 42 with a key way coupling.

We claim:

1. Apparatus for mounting an adjustable personnel platform to the end of the boom means of a lift device for maintaining the platform in a horizontal orientation over a wide range of movement of said boom means, said apparatus comprising:

a carrying arm (42) supporting the adjusting personnel platform (38);

a reversible motor (97);

a speed changing drive (66,67) mounted on the end of the boom means and interposed between said motor (97) and said carrying arm for rotating said carrying arm and platform with respect to the boom means by means of said motor, said drive having a worm gear input stage (66) driven by said motor (97), said input stage driving a planetary gear output stage (67) through a plurality of direction controlling couplings (81, 86) that arrest the rotation of the carrying arm (42) in both directions of rotation and that permit rotation of the carrying arm (42) in a respective one of the rotary directions of said motor (97) when driven in such direction by said motor; and control means having inclination sensing means (92) for sensing the orientation of the platform, said control means being coupled to said motor for energizing same responsive to the sensed orientation of the platform.

2. The apparatus according to claim 1 wherein said speed changing drive (66, 67) is further defined as having a hand wheel means (83, 84, 85) coupled to the input of said direction controlling couplings (81, 86 for driving said output stage (67) independently of said worm gear input stage.

3. The apparatus according to claim 1 wherein said planetary gear output stage (67) is further defined as comprising a plurality of series connected planetary gear drives (I, I′, I″).

4. The apparatus according to claim 1 wherein said motor is further defined as an electric motor having one of a plate or annular armature.

5. The apparatus according to claim 1 wherein said motor is further defined as an electric motor energizable by a battery power supply.

6. The apparatus according to claim 1 further defined as one for mounting an adjustable personnel platform to the end of a foldable boom means comprising a base boom (15), an intermediate member (21), and a flying boom (26) movable by linear motor means, said apparatus being further defined as selectively mounting the adjustable personnel platform to a coupling (29) suitable for mounting a concrete distribution conduit to said boom means.

7. The apparatus according to claim 1 further defined as formed so as to insulate the adjustable personnel platform from the end of the boom means.

* * * * *